US011118282B2

(12) United States Patent
Beauvir et al.

(10) Patent No.: US 11,118,282 B2
(45) Date of Patent: Sep. 14, 2021

(54) METHOD AND DEVICE FOR PRODUCING A WEAR-RESISTANT SURFACE ON A WORKPIECE

(71) Applicant: FORD GLOBAL TECHNOLOGIES, LLC, Dearborn, MI (US)

(72) Inventors: Jacques Beauvir, Damgan (FR); Urban Morawitz, Cologne (DE); Clemens Maria Verpoort, Monheim am Rhein (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 433 days.

(21) Appl. No.: 15/498,123

(22) Filed: Apr. 26, 2017

(65) Prior Publication Data

US 2017/0306519 A1 Oct. 26, 2017

(30) Foreign Application Priority Data

Apr. 26, 2016 (DE) ..... 102016207090.8

(51) Int. Cl.

| | |
|---|---|
| ***C25D 11/02*** | (2006.01) |
| ***C25D 17/00*** | (2006.01) |
| ***C25D 9/06*** | (2006.01) |
| ***C25D 11/04*** | (2006.01) |
| ***C25D 11/00*** | (2006.01) |

(52) U.S. Cl.

CPC ..... *C25D 11/026* (2013.01); *C25D 9/06* (2013.01); *C25D 11/005* (2013.01); *C25D 11/022* (2013.01); *C25D 11/04* (2013.01); *C25D 17/004* (2013.01)

(58) Field of Classification Search

CPC ..... C25D 7/04; C25D 11/022; C25D 11/026

See application file for complete search history.

(56) References Cited

U.S. PATENT DOCUMENTS

| | | | | |
|---|---|---|---|---|
| 4,853,099 | A * | 8/1989 | Smith | C25D 5/026 204/224 R |
| 4,875,983 | A | 10/1989 | Alota et al. | |
| 5,580,383 | A * | 12/1996 | Ikegaya | C25D 5/08 118/306 |
| 8,833,331 | B2 | 9/2014 | Schramm et al. | |
| 2007/0298186 | A1 * | 12/2007 | Yang | B21D 51/24 427/438 |
| 2010/0050977 | A1 | 3/2010 | Park | |
| 2016/0289856 | A1 | 10/2016 | Morawitz et al. | |

FOREIGN PATENT DOCUMENTS

| | | | |
|---|---|---|---|
| CA | 2556869 | A1 | 2/2008 |
| CN | 101713090 | A | 5/2010 |
| CN | 104551532 | A | 4/2015 |
| DE | 3905100 | A1 | 8/1990 |
| DE | 2007023297 | A1 | 2/2008 |
| DE | 102007023297 | A1 | 2/2008 |
| WO | 2015090267 | A1 | 6/2015 |

* cited by examiner

*Primary Examiner* — Louis J Rufo

(74) *Attorney, Agent, or Firm* — Brooks Kushman P.C.

(57) ABSTRACT

A method including closing upper and lower ends of a bore with upper and lower closure element, respectively; introducing a cathode into the bore; and flowing an electrolyte through an annular space between a wall of the bore an outer surface of the cathode to provide an inner surface of the bore with a wear-resistant surface by electrolysis.

20 Claims, 1 Drawing Sheet

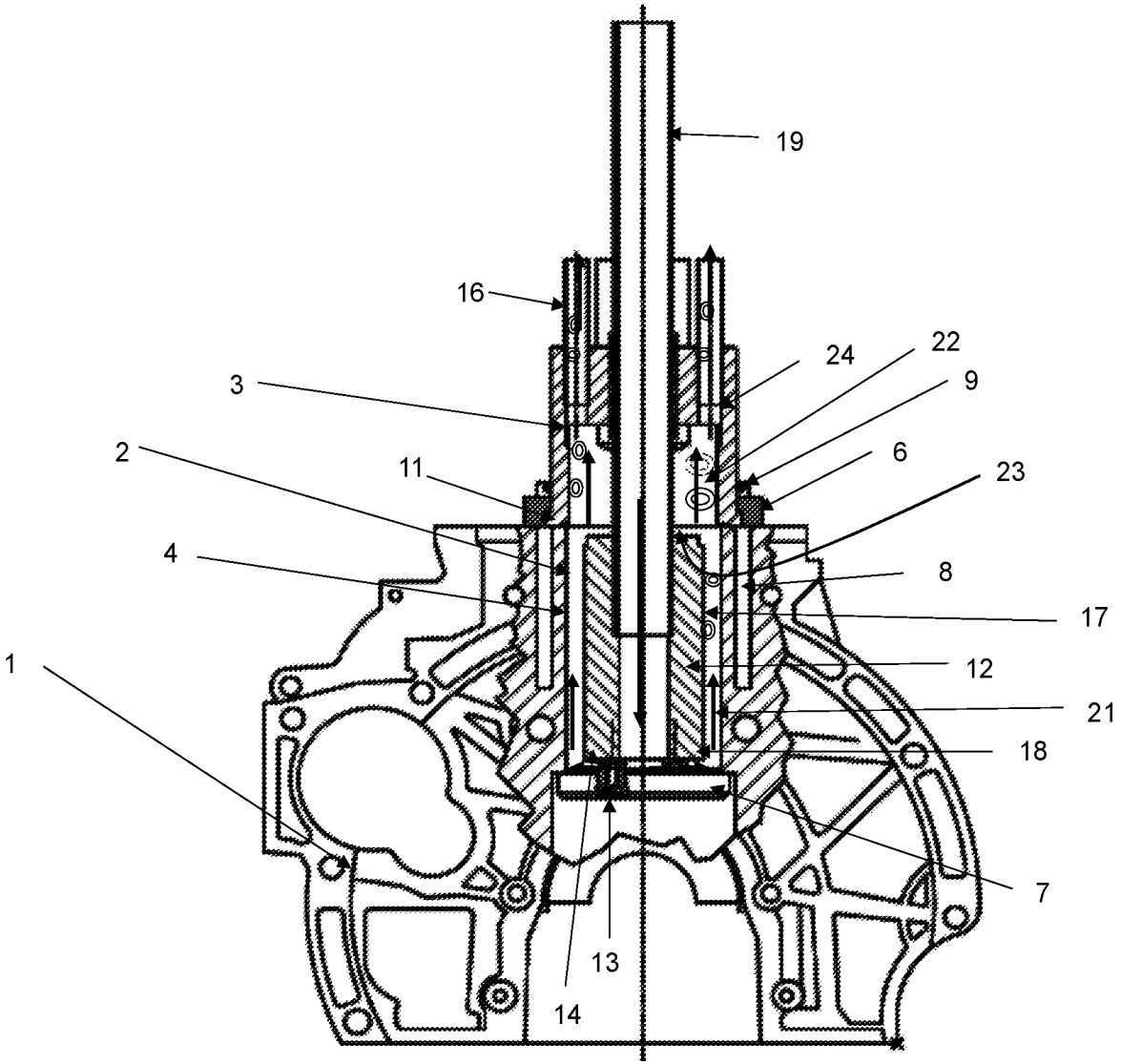
19
24
22
9
6
23
8
17
12
21
18
7
16
3
11
2
4
1
13
14

METHOD AND DEVICE FOR PRODUCING A WEAR-RESISTANT SURFACE ON A WORKPIECE

CROSS-REFERENCE TO RELATED APPLICATIONS

This application claims foreign priority benefits under 35 U.S.C. § 119(a)-(d) to DE 10 2016 207 090.8 filed Apr. 26, 2016, which is hereby incorporated by reference in its entirety.

TECHNICAL FIELD

The invention relates to a method for producing a wear-resistant surface on a workpiece using plasma electrolytic oxidation (PEO) or plasma electrolytic deposition (PED), for example. The invention also relates to a device for producing a wear-resistant surface.

BACKGROUND

A workpiece can be an engine block, for example, a crankcase made of aluminum or an aluminum alloy, which has at least one cylinder bore, in which a piston having piston rings moves up and down. Several cylinder bores, for example, two, three, four or more cylinder bores can also be provided. The cylinder bores have a sliding surface on which the piston rings of the piston slide. Aluminum crankcases require wear and friction protection on the sliding surface for the pistons. One known practice for achieving this is to embed gray cast iron cylinder liners during the casting process.

SUMMARY

It is an object of the invention to specify an improved method for producing a wear-resistant surface including a uniform layer thickness within the cylinder bore and other workpieces. It is a further object of the invention to provide a coating device to produce a uniform layer thickness within the cylinder bore.

The features and measures presented individually in the following description can be combined in any technically feasible way and give rise to further embodiments. The description additionally characterizes and specifies embodiments, particularly in conjunction with the figures. The expression "about" may refer to deviations from respective precise values of about ±10%, about ±5%, and/or deviations in the form of changes that are insignificant for functioning.

One or more embodiments disclose methods for producing a wear-resistant surface on a workpiece (e.g., one or more cylinder bores), made from aluminum or an aluminum alloy, for example, by electrolysis in that the wear-resistant surface is produced by plasma electrolytic oxidation (PEO) or plasma electrolytic deposition (PED). The upper and lower ends of a cylinder bore, which is open at both ends, are closed in a medium-tight manner. A central hollow cathode is introduced centrally into the at least one bore. "Medium-tight" may refer to gas- and liquid-tight sealing. The electrolyte is introduced continuously into the at least one cylinder bore. The electrolyte can be introduced into the at least one cylinder bore through the central hollow cathode. The electrolyte is guided along the cylinder bore and the hollow cathode in an annular space between the inner diameter of the at least one cylinder bore and the outside diameter of the central hollow cathode. The electrolyte is likewise discharged continuously, as is the hydrogen which forms during the electrolysis. This ensures that it is always fresh electrolyte which enters the cylinder bore.

In a method according to one or more embodiments, the workpiece is connected as the anode and the central hollow cathode is accordingly connected as the cathode. The central hollow cathode is arranged with its central axis centrally, i.e., in the middle, in the cylinder bore. The starting point of the method is a relatively coarsely machined cylinder bore, which is in the form of a monolithic aluminum block or in the form of an inserted wet or dry liner. The surface to be coated is composed of an aluminum alloy, e.g., from a hypoeutectic aluminum. A method is proposed for producing a cylinder sliding surface of an internal combustion engine, which is optimized in terms of friction and wear.

In one or more embodiments, a plurality of cylinder bores is arranged in the workpiece. Each cylinder bore is closed at the upper end and the lower end. A central hollow cathode is introduced into each of the cylinder bores. This ensures that the electrolyte can flow in the relevant annular space in each of the cylinder bores. Moreover, the coating of each cylinder bore can be carried out simultaneously or at time intervals, e.g., successively. It is expedient if the electrolyte flows in the annular space at a speed such that the diffusion and coating conditions in the cylinder bore wall region to be coated can develop in an optimum manner. Ideally, the electrolyte flows at a speed value of about 0.5 m/s to 1.5 m/s, and in other embodiments at a value of about 2 m/s to 5 m/s. If more gas bubbles, e.g., hydrogen bubbles formed during the electrolysis, adhere to the cylinder bore wall at a low speed of flow of the electrolyte, the thickness of the coating does admittedly increase. However, porosity likewise increases. For tribologically stressed coatings, however, it is advantageous to produce coatings which are as thin as possible but are dense. Thus, one or more embodiments are used to produce a very dense oxide coating with a thickness of about 20 to 50 μm, which may be particularly suitable in internal combustion engines. Control of the speed of flow and thus also of the flow rate of the electrolyte through the annular space thus brings about optimum layer formation during the entire coating process. The electrolyte flow avoids spark discharge at the same position and can be regarded as it were as a spark discharge on-off switch. The speed of flow can therefore be set individually, and the corresponding pump can be controlled accordingly.

It is also expedient in this respect if the annular space has a matching value in which an invariable annular space volume is produced. In one embodiment, the spacing of the outer diameter of the central hollow cathode from the inner wall of the cylinder bore to be coated is about 10 mm. However, it is also possible for a conically changing central hollow cathode to be introduced into the at least one cylinder bore. In this case, it is advantageous if the central hollow cathode tapers from the free end thereof in the direction of the other end, e.g., from the lower closure element in the direction of the upper closure element, with the result that the annular space value is accordingly increased continuously from the lower closure element, with a value of about 10 mm, in the direction of the upper closure element. Increasing the spacing between the at least one cylinder bore wall and the outside diameter of the central hollow cathode reduces the current density, and the layer thickness distribution can be influenced selectively through the precise design of the cone shape.

In one embodiment, the electrolyte is introduced into the relevant cylinder bore in such a way that it is deflected at the lower closure element and flows in the direction of the upper closure element. Thus, opposed electrolyte flows prevail in the cylinder bore. Within the hollow cathode, the electrolyte flows from the upper closure element in the direction of the lower closure element. Outside the central hollow cathode, the electrolyte flows from the lower closure element in the direction of the upper closure element. Thus, the lower closure element can be referred to as a baffle plate and the upper closure element can be referred to as an electrolyte plate. At the upper closure element, the electrolyte is discharged together with the gas which forms during the electrolysis, e.g., hydrogen.

To avoid accumulation of hydrogen gas under the closure element, e.g., under the upper closure element, at least one outlet opening, and in some embodiments, a plurality of outlet openings, as a further preference seven outlet openings, is/are provided in the closure element. The openings are spaced apart at equal intervals in the circumferential direction of the cylinder bore. Through the outlet openings, the hydrogen gas, together with the electrolyte, is fed to a collecting tank and cooled. In this tank, the electrolyte can degasify, and the hydrogen can be safely removed, e.g., safely removed by edge trough extraction. The outlet openings are connected to conduit elements, for example, suitable hoses, which open into the collecting tank. The conduit elements can also be combined into a common conduit element, which then opens into the collecting tank.

It is expedient if the central hollow cathode is arranged in the at least one cylinder bore in such a way that the free end of the central hollow cathode is spaced apart from the lower end of the cylinder bore, e.g., also from the relevant closure element, with the result that the abovementioned diversion of the flow direction of the electrolyte into the annular space can be achieved. In one or more embodiments, therefore, the electrolyte is passed into the cylinder bore centrally from above and, at the lower end of the cylinder bore, is compelled by the lower closure element to flow along the cylinder sliding surface in the annular space in the direction of the rising gas, e.g., hydrogen, bubbles. In this way, the hydrogen bubbles are discharged safely from the cylinder bore region to be coated, this being assisted by the flow of the electrolyte.

It is advantageous if foreign bodies, e.g., small beads of porous rubber and/or ground material/ceramic beads of about 0.2-2 mm or alternatively of about 2-10 mm, are mixed in with the electrolyte, said foreign bodies releasing the adhering hydrogen bubbles mechanically more quickly from the wall of the cylinder bore to be coated and carrying them away with the electrolyte. The coating time is thereby reduced and a smoother surface is obtained.

There is a brief spark discharge with the formation of aluminum oxide at the base of the discharge flash, typically about 50 μm in diameter and about 0.2-0.5 μm thick, with hydrogen gas then simultaneously being formed. This discharge is then restarted at a frequency of about 10-max. 1000 Hz, wherein the discharge then takes place next to those points which already have an insulating aluminum oxide layer. It is therefore advantageous per one or more embodiments if the hydrogen formed is removed quickly after the spark discharge to ensure that the additional spark discharges can take place undisturbed. In this way, a uniform layer thickness along the cylinder bore can be produced.

It is also expedient if the workpiece is connected to a vibration device to remove the hydrogen bubbles from the cylinder bore wall to be coated. In this case, vibration is imparted externally to the workpiece during the coating process, e.g., the workpiece is as it were shaken, making it more difficult for the hydrogen bubbles to adhere.

As already mentioned, the upper closure element has outlet openings. To enable accumulation of hydrogen gas, even under the upper closure element, even more reliably, a collecting space is provided, which is arranged on the closure element above the cylinder bore. Hydrogen which forms collects in the collecting space before it is passed into the external electrolyte tank. The deliberate accumulation of hydrogen outside the cylinder bore is advantageous because a hydrogen explosion when a spark is discharged in the upper region of the cylinder bore is prevented in this way. The collecting space is arranged in the manner of a hat on the upper closure element and may have a diameter matched to the cylinder bore, thus allowing the hydrogen to enter the collecting space unhindered. Of course, the clear diameter of the collecting space can also be somewhat smaller or larger than the diameter of the cylinder bore. From the collecting space, the gas formed during electrolysis is discharged together with the electrolyte flowing through the annular space.

To facilitate introduction of the pistons into the coated cylinder bore, provision can be made to machine a chamfer on the workpiece, e.g., on an upper region of the cylinder bore to be coated, before coating. After the coating process, the chamfer can remain unmachined since the roughness after coating is sufficient to allow the piston rings to be introduced. As compared with uncoated aluminum material in conventional aluminum blocks with embedded gray cast iron liners, the aluminum oxide coating improves the introduction of the steel piston rings. The coated sliding surface of the cylinder bore, on the other hand, undergoes final machining, e.g., is machined by honing or finishing, to further reduce the friction of the piston rings during operation of the engine. Only in the region of the cylinder head is the end reground and resurfaced to remove any scratches or traces of machining from the upper closure element and any handling marks. In the region of influence of the lower closure element, no re-machining is required since no sealing surfaces are affected.

In one or more embodiments, the electrolyte is operated with such ideal limit values in respect of its ideal deposition and process temperature that the engine block can be transferred to the final machining device, e.g., to the honing machine, at approximately room temperature, e.g., at a temperature of about 21° C.±1° C., after the end of the coating process, and the honing process can then follow directly. This setting of the temperature is directly dependent on the electrolyte volume and on the size of the heat exchanger tank and on the cooling capacity.

One or more embodiments present an electrolytic coating process, in particular, a PEO coating process to produce a uniform layer thickness within the cylinder bore. Of course, a PED coating process can also be carried out. The continuous flow of the electrolyte ensures that fresh electrolyte can be brought up continuously to the respective aluminum surface to assist the PEO process or PED process. At the same time, the hydrogen formed is carried away safely from the cylinder bore. Since the cylinder bore is sealed off in a medium-tight manner by the closure elements and additional sealing elements, the method can be carried out within an engine production line, wherein it is ensured that no mist, vapors or electrolyte can enter the environment. Although successive coating of a plurality of cylinder bores in a workpiece is conceivable, there is the enormous advantage that all the cylinder bores of a workpiece can be coated simultaneously. This considerably shortens the cycle time.

Of course, the coating method could also be carried out in such a way that the electrolyte could be introduced into the bore from below, e.g., from the bearing tunnel, and could be discharged with the dissolved hydrogen at the top at the upper closure element.

The coating device has an upper closure element and a lower closure element. If the workpiece has a plurality of cylinder bores, the upper closure element is embodied to correspond to the workpiece and completely covers all the cylinder bores. Thus, the upper closure element is a continuous electrolyte plate. A central hollow cathode is provided, which is arranged centrally in the at least one cylinder bore and extends from one closure element in the direction of the other closure element. The electrolyte is introduced into the cylinder bore and flows through an annular space between the inner wall of the cylinder bore and the outside diameter of the central hollow cathode, where an outlet device is provided. The electrolyte can be introduced into the cylinder bore through the central hollow cathode and flows through the annular space between the inner wall of the cylinder bore and the outside diameter of the central hollow cathode, where the outlet device is provided.

One of the closure elements is secured in a medium-tight manner on an upper side of the workpiece. If the workpiece has a plurality of cylinder bores, the closure element covers all the cylinder bores. To secure the upper closure element, use can be made of screw holes which are present in any case, these being provided for securing a cylinder head, for example. The medium-tight sealing can be achieved by sealing elements, e.g., O-rings, which can be arranged between the surface of the workpiece and the upper closure element at each cylinder bore. The closure element can be composed of a suitable material, e.g., plastic. Thus, the upper closure element can be secured on the sealing surface of the subsequent cylinder head in such a way that medium-tight sealing is achieved.

A closure element is likewise provided at the bottom, although a separate closure element is provided for each cylinder bore. The lower closure element closes the cylinder bore in a medium-tight manner in a suitable way. In one embodiment, provision is made to secure the lower closure element on the central hollow cathode. For this purpose, a screw can be provided, which passes through the lower closure element and is screwed into a free end of the central hollow cathode. Of course, it is also possible for a plurality of screws to be provided, which ensure that the lower closure element is secured relative to the lower end of the respective cylinder bore. By use of sealing elements, e.g., interposed O-ring seals, medium-tight sealing can be achieved. Instead of screwed joints, the lower closure element can also be pressed on and sealed in a medium-tight manner by means of clamping system.

In one or more embodiments, a single lower closure element closes all the cylinder bores in a medium-tight manner at the bottom. The lower closure element has an exclusively sealing function, while the upper closure element has not only a sealing function but also has both the central hollow cathode and the outlet device having a collecting space.

The central hollow cathode may extend from the upper closure element in the direction of the lower closure element. The central hollow cathode has a configuration such that the annular space can have a value of about 10 mm. Of course, the central hollow cathode can also be embodied with a taper from the lower free end in the direction of the upper end, with the result that the value of the annular space increases continuously. This has an advantageous effect on the layer thickness distribution, which can be influenced in this way. Of course, the configuration of the central hollow cathode depends on the clear diameter of the respective cylinder bore. In this case, it is not essential to define the wall thickness, but it may be necessary to modify the outside diameter to enable the optimum annular space volume with the optimum flow speed to be set to produce the coating with the optimum thickness and density. A free end of the hollow cathode is spaced apart from the lower closure element, e.g., is spaced apart from the latter by about 10 mm. It is possible for the central hollow cathode to have a variable outside diameter along the central axis thereof. Thus, the configuration of the central hollow cathode is not restricted solely to the cylindrical or conical configuration mentioned by way of example. On the contrary, the central hollow cathode can have any suitable external contour, thus allowing a respectively desired layer thickness variation to be achieved.

The electrolyte is thus introduced from above into the cylinder bore through the central hollow cathode and diverted at the lower closure element and forced into the annular space, where hydrogen bubbles are taken along with the flow.

The hydrogen bubbles may accumulate below the upper closure element, where a discharge device is advantageously provided. In one embodiment, at least one outlet opening is arranged in the upper closure element. This is connected to a conduit element, for example, to a hose, which carries the electrolyte away into a collecting tank, together with the hydrogen which forms during electrolysis. In one embodiment, a plurality of outlet openings, ideally seven outlet openings, is/are provided, which are each spaced apart at identical intervals when viewed in the circumferential direction of the cylinder bore. In this way, safe discharge of the gas which forms, including the hydrogen, is ensured. Each outlet opening is assigned a conduit element, wherein the conduit elements can be combined into a common conduit element before they open into the collecting tank.

In another embodiment, the coating device has a collecting space, which is arranged above the respective cylinder bore. The collecting space is arranged as a hat-like raised portion on the upper closure element. The collecting space has an inflow opening, which corresponds approximately to the diameter of the cylinder bore to be coated. At the top end, the collecting space is closed by a cap. The outlet openings, which discharge the accumulated hydrogen but also the electrolyte, are arranged in the cap. An inlet line is also arranged in the cap. The inlet line passes through the collecting space and opens into the central hollow cathode. Electrolyte is introduced through the inlet line into the cylinder bore, flowing through the central hollow cathode in the direction of the free end thereof. Thus, the electrolyte is not only fed in from above but is also discharged at the top together with the hydrogen which forms. Of course, a single outlet opening can be arranged in the cap of the collecting space, or a plurality of outlet openings, for example, seven outlet openings. As described above, the electrolyte is passed into a collecting tank with the hydrogen and is cooled there. In the tank, which is possibly open, the electrolyte can degasify, and the hydrogen can be removed safely by edge trough extraction. The collecting space can be connected in a medium-tight manner as a separate element to the upper closure element. In one embodiment, the collecting space is formed directly on the closure element.

The coating device in one or more embodiments can be used in a way which is effectively manageable in terms of production technology to produce a coating that is particularly suitable tribologically. One or more embodiments relate to internal combustion engines and is, of course, not restricted solely to reciprocating piston engines. The use of the method disclosed in one or more embodiments and the coating device as disclosed one or more embodiments for coating rotary piston engines is conceivable. It is expedient here that the outside diameter of the central hollow cathode can be adapted variably to the surface to be coated, e.g., is variable. It is also in accordance with one or more embodiments to provide not only internal combustion engines but all devices in which an improvement in tribological properties is worthwhile with the coating that can be produced as disclosed one or more embodiments. It is worthwhile to use one or more embodiments in the case of piston compressors, for example, for air blowers. One or more embodiments are also not restricted to the material mentioned by way of example. It is also conceivable, for example, to produce the workpiece, for example, the crankcase, from magnesium or from a magnesium alloy, which is then coated by use of any disclosed method and of the coating device by use of PEO or PED.

BRIEF DESCRIPTION OF THE DRAWINGS

Further features and advantages of the invention will become apparent from the following description of an illustrative embodiment of the present invention, which should not be interpreted as restrictive and which is explained in greater detail below about the drawing.

FIG. 1 shows an engine block in schematic view with a cylinder bore to be coated and, schematically, a coating device.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Although gray cast iron material is tribologically well-suited to stress imposed by piston rings because of the graphite flakes that are present in the gray cast iron, such cylinder liners have several disadvantages. In addition to the increased weight, problems arise with the differential thermal expansion of the gray cast iron material and the aluminum block material. Increasingly, therefore, use is being made of thermal spray coatings, for example, those disclosed in DE 10 2007 023 297 A1. With such thermal spray coatings, however, it is typically necessary to carry out an expensive surface pretreatment to obtain sufficient adhesion of the functional coating on the aluminum substrate. Either the sliding surface must be roughened by corundum or water jets, or a micro-profile with an undercut is introduced into the surface by a turning spindle process. A porous sprayed steel layer with a thickness of about 300 μm is then applied to a surface prepared in this way and subsequently machined down to a remaining final layer thickness of 80-150 μm by honing.

Thermal spray coatings of this kind may have one or more technical and cost problems. Owing to the porous layer, for example, there can be sub-surface corrosion in the presence of fuels, especially ethanol/methanol fuels. On the other hand, there can be significant overspray forming dust that must be extracted and disposed of. The method may give rise to rough layers, which then must be removed in an expensive honing operation until a surface suitable for operation is obtained.

Thin PEO coatings based on aluminum oxide or PED coatings based on titanium oxide therefore appear to be more suitable. These do not require expensive surface pretreatment and are distinguished by the very high adhesive strength of the functional coating. At the interface with the aluminum substrate, a thin barrier layer forms, providing good protection for the material against corrosive attack. The quantity of waste generated is negligible and only a very short honing operation for final machining is required, with a thin, smooth coating.

Although the entire engine block, including all the available cylinder bores, could also be coated in a treatment bath, for this coating process, there are not only higher costs for power but also technical disadvantages. Thus, different layer thicknesses and zones of different porosity are formed within the sliding surface owing to the nonuniform flow through the bore by the electrolyte used.

CA 2,556,869 A1 discloses that the electrolyte is sprayed against the inside of the cylinder sliding surface by a hollow rotating spindle in the PEO process using the "electro-jet plating" method. In this case, there is a horizontal outflow nozzle at the lower end of the spindle. This nozzle rotates at an adjustable speed around the spindle and is moved backward and forward vertically until the entire surface has been treated. During this process, the electrolyte can run off into an electrolyte collecting trough. The disadvantage with this coating arrangement may also be regarded as the fact that the engine sliding surface cannot be hermetically sealed in the presence of the vapors and spray mist which occur.

In one or more embodiments, improved methods and devices for producing a wear-resistant surface including a uniform layer thickness within a cylinder bore are disclosed.

With respect to one embodiment, FIG. 1 shows a workpiece 1, which is embodied as an engine block or crankcase. By way of example, the workpiece is produced from an aluminum or an aluminum alloy. A bore 2, e.g. a cylinder bore 2, is arranged in the workpiece 1. A coating device 3, can be used to electrolytically coat the wall 4 of the cylinder bore 2. As an electrolytic coating method, plasma electrolytic oxidation (PEO) or plasma electrolytic deposition (PET) is carried out. Four cylinder bores 2, for example, of which only one is visible, can be arranged in the workpiece 1. The coating device 3 has an upper closure element 6 and a lower closure element 7.

If the workpiece 1 has a plurality of cylinder bores 2, the upper closure element 6 covers all the cylinder bores 2. To secure the upper closure element 6, use can be made of screw holes 8 which are present in any case, these being provided for securing a cylinder head, for example. Suitable screws 9, of which only the screw heads are indicated in FIG. 1, are screwed into the screw holes 8. The medium-tight sealing can be achieved by sealing elements, e.g. by means of O-rings 11, which can be arranged between the surface of the workpiece 1 and the upper closure element 6 at each cylinder bore 2. The upper closure element 6 can be composed of a suitable material, e.g., a plastic material. Thus, the upper closure element 6 can be secured on the sealing surface of the subsequent cylinder head in such a way that medium-tight sealing is achieved.

The lower closure element 7 is provided at the bottom, although a separate lower closure element 7 is provided for each cylinder bore 2. The lower closure element 7 closes the cylinder bore 2 in a medium-tight manner in a suitable way.

In one embodiment, provision is made to secure the lower closure element 7 on a central hollow cathode 12. For this purpose, a screw 13 can be provided, which passes through the lower closure element 7 and is screwed into a free end 14 of the central hollow cathode 12. Of course, it is also possible for a plurality of screws to be provided, which ensure that the lower closure element 7 is secured relative to the lower end of the respective cylinder bore 2. By use of sealing elements, for example, interposed O-ring seals, medium-tight sealing is ensured in this way.

The central hollow cathode 12 may extend from the upper closure element 6 in the direction of the lower closure element 7. The central hollow cathode 12 is arranged with its central axis centrally in the cylinder bore 2 and has an embodiment such that an annular space 17 between the outside diameter of the central hollow cathode 12 and the inner wall of the cylinder bore 2 can have a constant value of about 10 mm. Of course, the central hollow cathode 12 can also be embodied with a taper from the lower free end 18 in the direction of the upper end, with the result that the value of the annular space 17 increases continuously from about 10 mm. This has an advantageous effect on the layer thickness distribution, which can be influenced in this way. Of course, the configuration of the central hollow cathode 12 depends on the clear diameter of the respective cylinder bore 2. In this case, it is not essential to define the wall thickness, but it may be necessary to modify the outside diameter to enable the optimum annular space volume with the optimum flow speed to be set to produce the coating with the optimum thickness and density. The free end 18 of the central hollow cathode 12, e.g., the free end 14, is spaced apart from the lower closure element 7, e.g., spaced apart from the latter by about 10 mm.

In the coating process, an electrolyte is passed through the central hollow cathode 12 from above into the cylinder bore 2, which is closed in a medium-tight manner at both ends. For this purpose, an inlet line 19 is provided, passing through the upper closure element 6 and opening into the central hollow cathode 12. In one embodiment, the inlet line 19 is connected to the central hollow cathode 12 to be secured in position, and therefore the central hollow cathode 12 is held in a stable position in the cylinder bore 2 by the inlet line 19. The electrolyte enters the central channel of the central hollow cathode 12 and emerges from the free end 18 of the central hollow cathode 12, and reaches the lower closure element 7, with the result that the electrolyte is deflected in its flow direction and flows through the annular space 17 in the direction of the upper closure element 6. The flow of electrolyte is illustrated by arrows 21 in FIG. 1.

The workpiece 1 is connected as the anode. The central hollow cathode is connected as the cathode, thus allowing electrolysis, i.e. PED or PEO, to be carried out. The individual circuit elements, for example, cables, are not shown in FIG. 1. In this case, it is ensured that the electrolyte flows through the optimum annular space volume at a predetermined flow speed and is discharged at the top, e.g., by flowing through the upper closure element 6, together with the hydrogen formed during electrolysis. The hydrogen formed can be seen by the indicated circles in FIG. 1.

For this purpose, the coating device 1 in the illustrative embodiment shown has a collecting space 22, which is arranged above the respective cylinder bore 2. The collecting space 22 is arranged as a hat-like raised portion on the upper closure element 6. The collecting space 22 has an inflow opening 23, which corresponds approximately to the diameter of the cylinder bore 2 to be coated. At the top end, the collecting space 22 is closed by a cap 24. Outlet openings 16, which discharge accumulated hydrogen but also the electrolyte, are arranged in the cap 24. Also arranged in the cap 24 is the inlet line 19, which passes through the collecting space 22 and opens into the central hollow cathode 12. Through the inlet line 19, electrolyte is introduced into the cylinder bore 2, flowing through the central hollow cathode 12 in the direction of the free end thereof 18. Thus, the electrolyte is not only fed in from above but is also discharged at the top together with the hydrogen, which forms. Of course, a single outlet opening 16 can be arranged in the cap 24 of the collecting space 22, or a plurality of outlet openings 16, e.g., seven outlet openings 16. The electrolyte is passed into a collecting tank (not shown) with the hydrogen from the collecting space 22 and is cooled there. In the collecting tank, which is possibly open, the electrolyte can degasify, and the hydrogen can be removed safely by edge trough extraction.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A device comprising:

upper and lower closures configured to close a bore of a crankcase, the upper closure having screw holes configured to secure the upper closure to the crankcase via screws;

a cathode extending within the bore from the upper closure towards the lower closure to form an annular space between a bore wall and an outer surface of the cathode and configured to receive a flow of an electrolyte therethrough during electrolysis; and outlet openings formed in the upper closure and configured to discharge a gas formed during electrolysis.

2. The device of claim 1, further comprising an inlet line configured to feed the electrolyte into the cathode during electrolysis.

3. The device of claim 1, wherein a free end of the cathode is spaced apart from the lower closure.

4. The device of claim 1, wherein the annular space between the bore and the cathode increases continuously in the direction of the lower closure towards the upper closure with a conically tapering configuration of the cathode from a free end in the direction of the upper closure.

5. The device of claim 1, wherein the cathode is a hollow cathode.

6. The device of claim 1, further comprising a collecting space situated above the bore and on the upper closure element in which space gas that forms during the electrolysis collection.

7. The device of claim 1, wherein the outlet openings comprise seven outlet openings.

8. The device of claim 6, wherein the collection space includes an inflow opening corresponding approximately to a diameter of the bore wall.

9. A device comprising:

upper and lower closures configured to close a bore of a crankcase, the upper closure having screw holes configured to secure the upper enclosure to the crankcase via screws; and a hollow cathode extending within the bore from the upper closure towards the lower closure to form an annular space between a bore wall and an outer surface of the cathode and configured to receive a flow of an electrolyte therethrough during electrolysis; and outlet openings formed in the upper closure and configured to discharge a gas formed during electrolysis.

10. The device of claim 9, further comprising an inlet line configured to feed the electrolyte into the cathode during electrolysis.

11. The device of claim 9, further comprising a collecting space situated above the bore and on the upper closure element in which space gas that forms during the electrolysis collection.

12. The device of claim 9, wherein the outlet openings comprise seven outlet openings.

13. The device of claim 11, wherein the collection space includes an inflow opening corresponding approximately to a diameter of the bore wall.

14. A device comprising:

upper and lower closures configured to close a bore of a crankcase, the upper closure having screw holes configured to secure the upper closure to the crankcase via screws;

a cathode extending within the bore from the upper closure towards the lower closure to form an annular space between a bore wall and an outer surface of the cathode and configured to receive a flow of an electrolyte therethrough during electrolysis;

outlet openings formed in the upper closure and configured to discharge a gas formed during electrolysis;

a hat-like raised portion on the upper closure configured to collect gas formed during electrolysis; and a cap configured to close the hat-like raised portion and including an outlet opening configured to discharge the electrolyte and the gas.

15. The device of claim 14, further comprising an inlet line configured to feed the electrolyte into the cathode during electrolysis.

16. The device of claim 14, wherein a free end of the cathode is spaced apart from the lower closure.

17. The device of claim 14, wherein the annular space between the bore and the cathode increases continuously in the direction of the lower closure towards the upper closure with a conically tapering configuration of the cathode from a free end in the direction of the upper closure.

18. The device of claim 14, wherein the cathode is a hollow cathode.

19. The device of claim 14, wherein the outlet openings comprise seven outlet openings.

20. The device of claim 14, wherein the hat-like raised portion includes an inflow opening corresponding approximately to a diameter of the bore wall.

* * * * *